United States Patent [19]

Cressi

[11] Patent Number: 4,954,111

[45] Date of Patent: Sep. 4, 1990

[54] SWIMMING FLIPPER MADE OF TWO DIFFERENT MATERIALS

[75] Inventor: Leopoldo A. Cressi, Genoa, Italy

[73] Assignee: Cressi-Sub S.p.A., Genoa, Italy

[21] Appl. No.: 264,266

[22] Filed: Oct. 28, 1988

[30] Foreign Application Priority Data

Nov. 30, 1987 [IT] Italy ..... 12591 A/87

[51] Int. Cl.[5] ..... A63B 31/11

[52] U.S. Cl. ..... 441/61; 441/64

[58] Field of Search ..... 441/61-64

[56] References Cited

U.S. PATENT DOCUMENTS

| | | | |
|---|---|---|---|
| 2,903,719 | 9/1959 | Wozencraft | 441/64 |
| 3,302,222 | 2/1967 | Ferraro | 441/64 |
| 3,922,741 | 12/1975 | Semeia | 441/64 |

FOREIGN PATENT DOCUMENTS

| | | | |
|---|---|---|---|
| 2543004 | 9/1984 | France | 441/64 |
| 2128096 | 4/1984 | United Kingdom | 441/64 |

*Primary Examiner*—Joseph F. Peters, Jr.
*Assistant Examiner*—Edwin L. Swinehart
*Attorney, Agent, or Firm*—Emmanuel J. Lobato; Robert E. Burns

[57] ABSTRACT

The invention refers to a swimming flipper of the type with a "shoe" part (10) made of relatively soft material and a blade part (20), made of relatively stiffer material, suitably joined to one another and preferably formed with the first part on top of the second. According to this invention, the blade (20) has an outer sole (22) which extends right under the heel (11) of the shoe (10). Furthermore, the blade (10) is equipped with an arched strap (23) which surrounds the upper (13) of the shoe transversally (FIG. 6).

6 Claims, 4 Drawing Sheets

SWIMMING FLIPPER MADE OF TWO DIFFERENT MATERIALS

BACKGROUND OF THE INVENTION

Swimming flippers made of two different materials are known, and particularly those with a soft rubber shoe while the actual flipper is made of a stiffer material. This stiffer material may consist of rubber with different properties, harder, or of a suitable synthetic material.

The purpose of the softer material of the shoe is of course increased comfort for the swimmer's feet, which do not come into contact with excessively hard materials capable in the long term of interfering with blood circulation.

On the other hand, an excessively soft shoe has the drawback that it may give way under the resistance offered by the flipper, reducing the latter's hydrodynamic efficiency.

The purpose of this invention is to overcome this drawback by means of a swimming flipper in which the shoe, made of a sufficiently soft material, is connected to the flipper in such a way that the movement of the foot inside the shoe is in any case transmitted to the actual flipper.

BRIEF SUMMARY OF THE INVENTION

According to this invention, the substantially flat part of the actual flipper, hereinafter called simply the blade, made of a harder material than the shoe, extends right under the heel of the shoe.

In this way, the deformation imposed on the blade inevitably remains tangent to the sole of the foot, without a more or less wide angle forming between the underside of the heel and the rear edge of the blade due to the different stiffnesses of the two parts of the flipper, as is the case with known flippers.

Furthermore, according to this invention, the "outer sole" which forms the rear part of the blade and which extends under the heel of the shoe, is equipped with an arched upper transverse strip which surrounds the upper part of the shoe in a manner similar to the strap of a sandal, and since it is at least partly embedded in the thickness of the softer material of the shoe, it does not trouble the swimmer in any way.

It follows that the blade, made of a stiffer material, extends right under the heel and surrounds the front of the swimmer's foot, but leaves his toes free, so that the movement of his foot is transmitted wholly to the blade of the flipper without his foot being caught in the tight grip of stiff walls.

Figure 1:
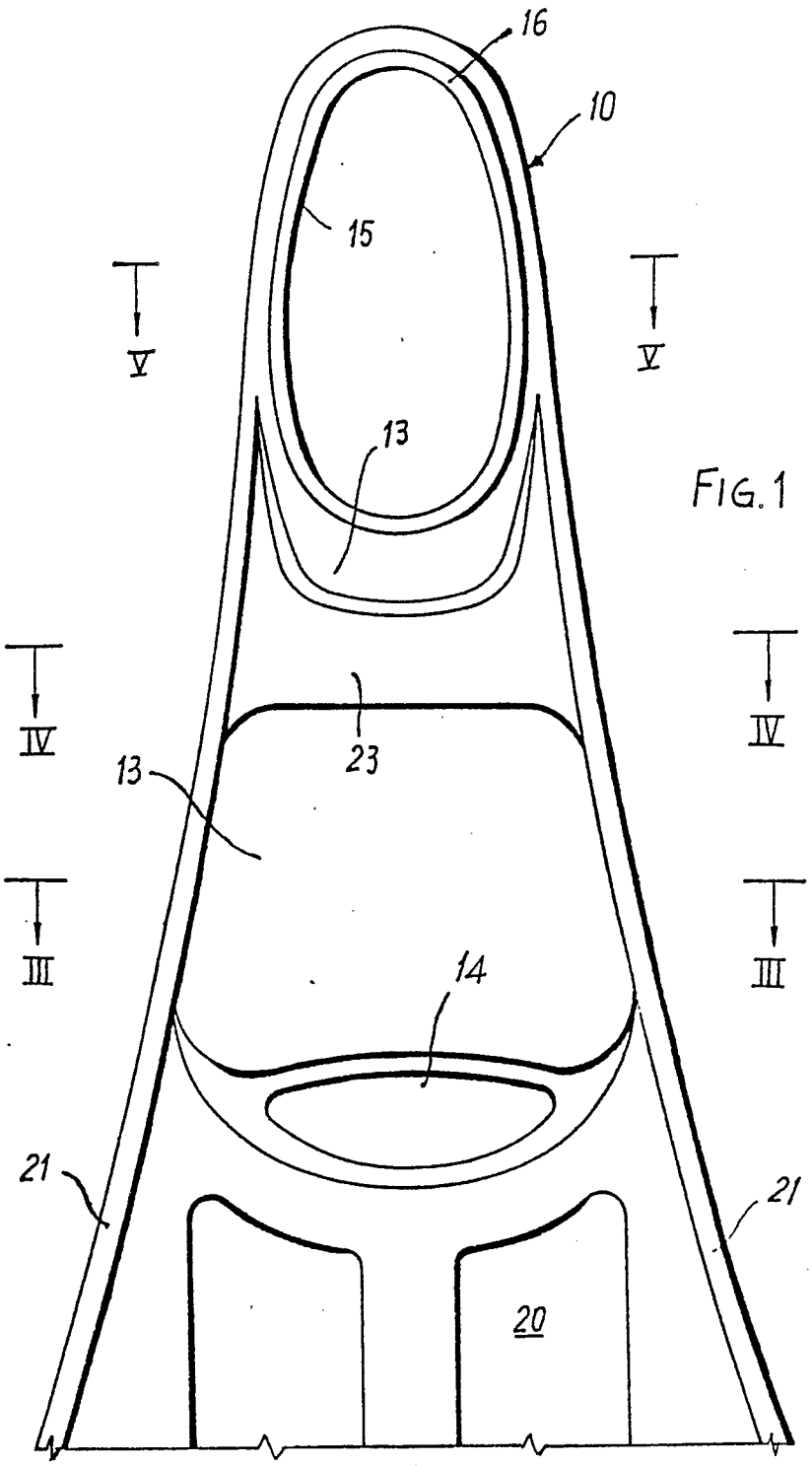
FIG. 1 shows a flipper according to the invention, seen from above.
Figure 2:
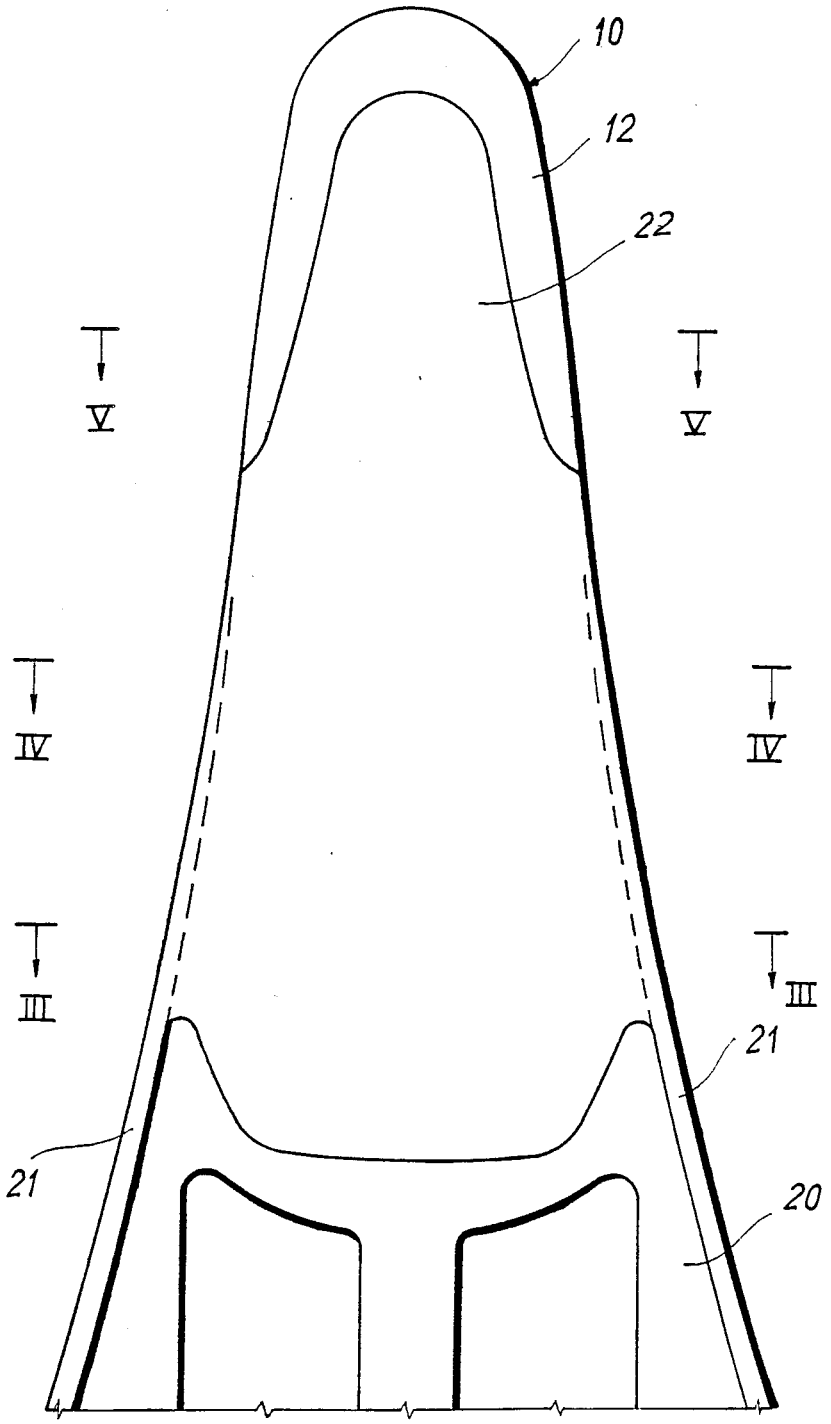
FIG. 2 shows the same flipper, seen from underneath.
Figure 3:
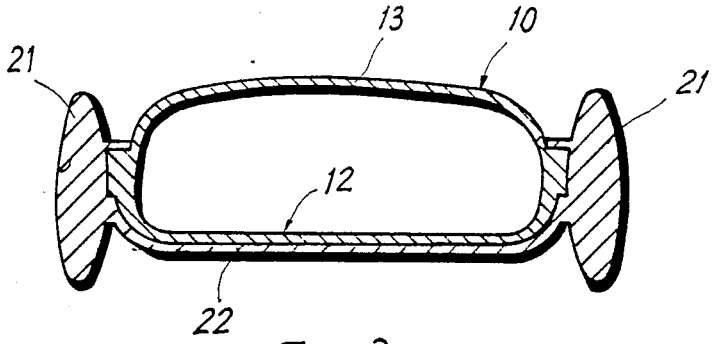
FIGS. 3, 4 and 5 are cross-sections of the blade on the secant planes III—III, IV—IV and V—V of FIGS. 1 and 2.
Figure 4:
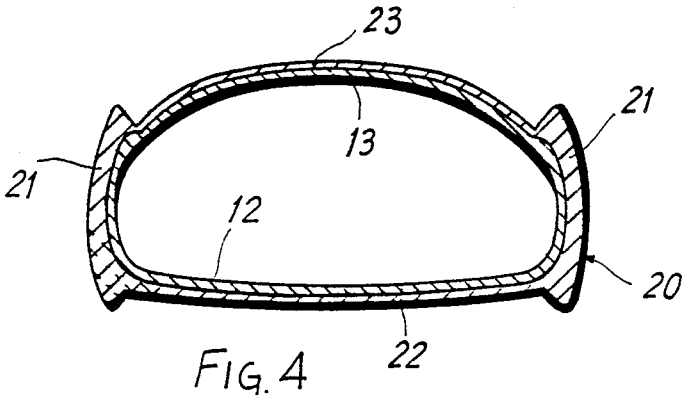
Figure 5:
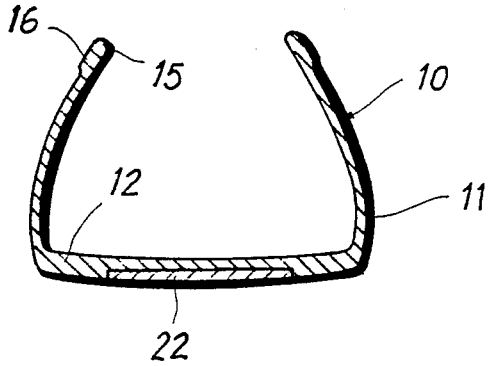
Figure 6:
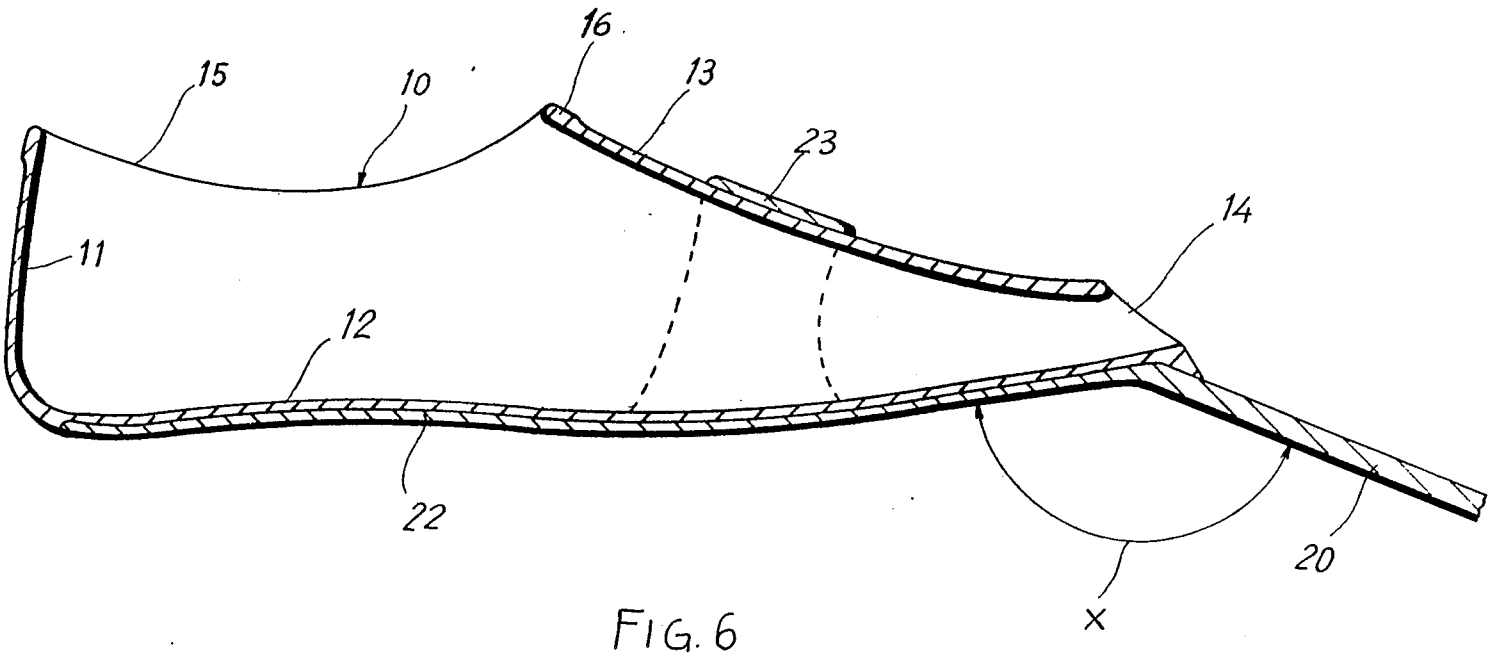
FIG. 6 is a vertical and longitudinal cross-section of the flipper on line VI—VI of FIGS. 1 and 2. DETAILED DESCRIPTION OF THE PREFERRED EMBODIMENT With particular reference to the above figures.

As shown very clearly in FIG. 6, the flipper according to the invention consists of a show (19;, closed at the rear by a heel 11, equipped with a thin sole 12, and an upper 13.

The upper 13 has a front opening 14 which allows the toes of the foot to pass comfortably and which is surrounded by a soft thickening of the same soft material as the rest of the shoe 10.

The upper opening 15 of the shoe is also surrounded by a soft thickening 16.

In general, the shoe 10 is made of a relatively soft material, like rubber, in a molding stage which takes place after the molding of the blade 20, made first. The blade 20 is made of a harder material than the shoe, and the front part has a basically trapezoid shape with stiffening thicknesses 21 along the two side edges.

It is a known fact that the plane of the blade 20 forms a 180° angle with the plane of the sole 12 of the shoe. According to the invention, the blade 20 extends right under the sole 12 of the shoe 10, by means of a kind of outer sole, extending right under the heel of the shoe 10.

So that the greater stiffness of the blade 20 is not wholly transmitted to the shoe 10, at about 0.3–0.5 of the length of the shoe starting from the heel of the shoe itself, the outer sole 22 narrows down but maintaining a sufficient width to guarantee long life. The outer sole 22, therefore, allows a direct downward thrust to be transmitted to the blade without excessive bending at the joint with the blade, with a consequent increase of the angle (A).

The invention, however, allows the same goal to be achieved when the foot is moved upwards: in this case the angle (A) would tend to close, and therefore the angular movement of the blade would tend to be less than the angular movement of the foot, with a consequent drop in hydrodynamic efficiency.

This natural increase of the angle (A) is inevitable in flippers of the known type, due to the greater flexibility of the shoe 10 as compared to the blade 20. According to the invention, in order to overcome this drawback, the outer sole 22 is fitted with an upward arching strap 23, surrounding transversally the upper of the shoe 10, holding the foot against the outer sole 22 and thus against the blade 20, when the foot is moved upwards.

The width of the strap 23, which is also enclosed on its sides and underneath by the softer material of the shoe, fixes the foot firmly to the blade without gripping it uncomfortably: the whole instep and heel remain free to move at the rear and sides, albeit surrounded by the material of the shoe.

Above all, it is important that forwards from the position of the strap 23, the toes are completely free to move, ensuring that cramps will not occur even after prolonged immersion.

What is claimed is:

1. A swimming flipper comprising, a shoe made of a relatively resilient material and having a sole and an upper having a heel and open at the front for the toes of a wearer to extend therethrough, a blade made of a lesser resilient material than the shoe molded on the sole of the shoe extending forwardly of the shoe and having a portion thinner in thickness extending toward the heel of the shoe defining an outer sole of the shoe, said outer sole narrowing in width toward the heel of the shoe starting about half way along the length of the shoe and terminating at the heel of the shoe, the blade having opposite side edge ribs for stiffening thereof, and an arched outer strap extending over a front part of the shoe integrally joining the side edge ribs with each other, said outer strap being made of a material less resilient than the shoe and embedded therein.

2. A swimming flipper according to claim 1, in which the outer sole width is narrower than the sole of the shoe at the heel.

3. A swimming flipper according to claim 1, in which said outer strap is forward of an instep portion of the shoe.

4. A swimming flipper according to claim 1, in which the blade extending forwardly of the shoe extends in a direction downwardly of the sole of the shoe.

5. A swimming flipper according to claim 4, in which said sole of the shoe is of less thickness than the outer sole and the forwardly extending blade is of greater thickness than the outer sole.

6. Swimming flipper of the type with a shoe made of relatively soft material and a blade made of relatively harder material, connected to one another by being molded together with the former on top of the latter, characterized in that said blade has an outer sole which extends right under the heel of the shoe and in which, furthermore, said blade is equipped with an arched strap, made of a material less resilient than the shoe, which is embedded in the shoe and surrounds the front part of the shoe; wherein said outer sole narrows in width towards the rear, starting from about half way along the shoe; and wherein the blade is equipped with side ribs; said arched strap starting from the upper edges of these ribs and connecting them to one another.

* * * * *